US005098366A

United States Patent [19]

Gressman

[11] Patent Number: 5,098,366

[45] Date of Patent: Mar. 24, 1992

[54] ROTARY CUTTERS FOR BUSINESS FOLDERS WITH MULTIPLE TAB OPTIONS

[76] Inventor: Richard H. Gressman, 37381 Pocahontas, Mt. Clemens, Mich. 48043

[21] Appl. No.: 367,441

[22] Filed: Jun. 16, 1989

[51] Int. Cl.[5] ..... B66D 1/62; B31B 1/16

[52] U.S. Cl. ..... 493/354; 83/305; 83/482; 83/561; 83/659; 493/370; 493/471; 493/477; 493/947

[58] Field of Search ..... 83/482, 561, 331, .659, 83/304, 305, 673, 346, 344, 347; 493/354, 947, 370, 471, 475, 477, 478

[56] References Cited

U.S. PATENT DOCUMENTS

| | | | |
|---|---|---|---|
| 2,138,788 | 11/1938 | Hart et al. | 493/947 X |
| 3,570,348 | 3/1971 | Hallden | 83/305 X |
| 3,731,575 | 5/1973 | Gelin | 83/561 X |
| 4,054,071 | 10/1977 | Patejak | 83/305 X |
| 4,159,661 | 7/1979 | Russell et al. | 83/305 |
| 4,319,506 | 3/1982 | Warren et al. | 83/561 X |
| 4,742,741 | 5/1988 | Hallberg et al. | 83/305 |

*Primary Examiner*—Douglas D. Watts
*Assistant Examiner*—Kenneth E. Peterson
*Attorney, Agent, or Firm*—Barnes, Kisselle, Raisch, Choate, Whittemore & Hulbert

[57] ABSTRACT

A machine for cutting filing folders to provide identification tabs which includes the use of two rollers, a cutter roller and an anvil roller. The cutter roller has a plurality of surface cutters spaced circumferentially to cut identification tabs selectively at each end and centrally of a folder. The anvil roller has clearance areas, and also an anvil area which will cooperate with one of the surface cutters depending on the circumferential orientation of the cutter roller. The machine provides for a gear drive for the rollers and a mechanism for lifting and adjusting the orientation of the cutter roller to effect cutting of the file edges with one of the surface cutters.

5 Claims, 3 Drawing Sheets

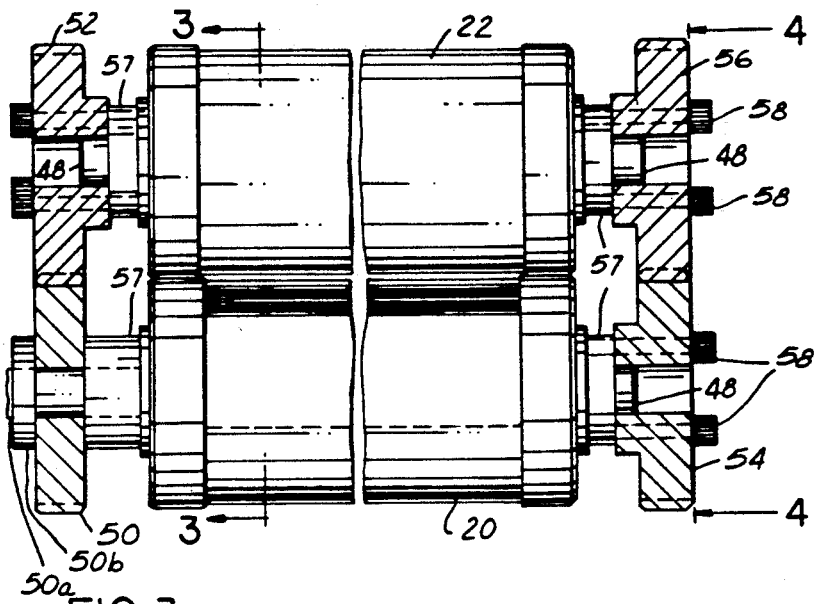
FIG.2
FIG.3
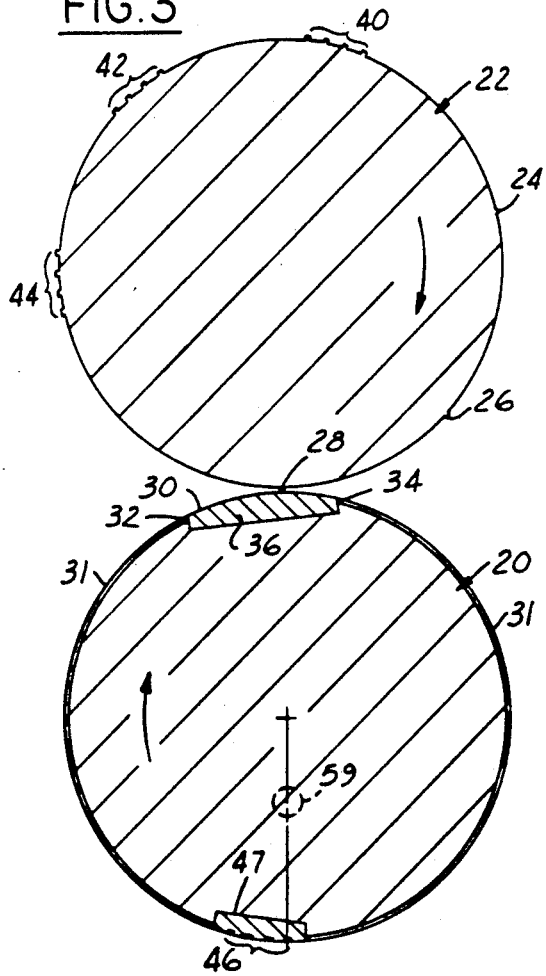
FIG.4
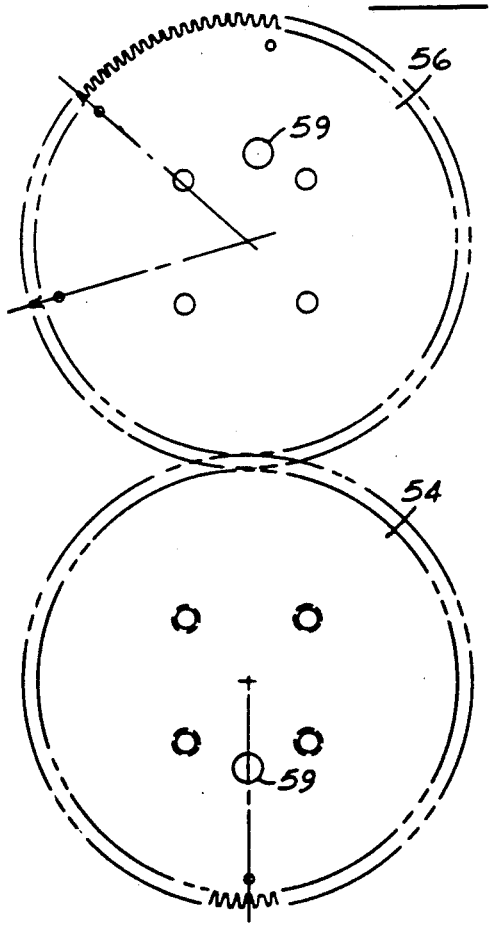

ROTARY CUTTERS FOR BUSINESS FOLDERS WITH MULTIPLE TAB OPTIONS

FIELD OF INVENTION

Machines with gear driven rotors used to cut the edges of manila folders to provide upstanding tabs for identification.

BACKGROUND AND FEATURES OF THE INVENTION

Pale yellow manila folders have been used for many years to store business papers in file drawers. These folders are made from a paper which has a certain stiffness above that of ordinary stationery and upstanding tabs are provided on one of the top edges for carrying identification titles or data pertaining to the particular material in the folder. If all the tabs are on one location, for example, on the left upper corner, the front tabs will obscure the tabs of the rearward tabs unless the folders contain enough material to widen the space between the folders.

Accordingly, it has been a practice to provide multiple tabs, as, for example, a left tab, a center tab, and right tab. When these tabs are staggered horizontally in a drawer, they are much easier to identify and they do not obscure each other.

For some years, these folders have been made from a continuous roll of basic material which is cut into proper lengths, folded, and one of the edges cut to provide an identification tab which projects above the general edges of the folder. In the cutting of the edges of the folders, two rollers are utilized, one serving as an anvil roller and the other roller having a cutting edge which acts on the sheet supported on the anvil to cut the edges. In the known art, it has been necessary to replace the cutting roller to obtain a different tab location. This involves disassembling the machine, disengaging drive gears, replacing the cutter roller with a different tab cut and reassembling the parts to run a batch of folders with a different tab location. Frequently, these folders have multiple, closely spaced crease marks at the folded area to allow the folder to expand as it is filled.

The present invention is directed to a machine for accomplishing the cutting of multiple folder tabs without the need for using separate rollers. This is accomplished by providing a plurality of cutter knives on a single roller spaced circumferentially and arranged to be sequentially and selectively positioned to register with an anvil surface on a base roller, each cutter knife being formed to cut a different identification tab. The knives are selectively positioned to register with an anvil surface by temporarily disengaging the drive gears, shifting a roller circumferentially and re-engaging the gears. Accordingly, only one roller is needed to achieve the desired variety of tabs.

The invention also is directed to a quick release mechanism to facilitate the circumferential adjustment of the rollers with a manual lift to separate the rollers for adjustment.

Features and object of the invention will be apparent in the following description and claims in which the details of the invention are disclosed to enable persons skilled in the art to practice the invention, all in connection with the best mode presently contemplated for the practice of the invention.

BRIEF DESCRIPTION OF THE DRAWINGS

DRAWINGS accompany the disclosure and the various views thereof may be briefly described as:

FIG. 2, an elevation of the main rollers of the mechanism.

FIG. 3, a view on line 3—3 of FIG. 2.

FIG. 4, a view on line 4—4 of FIG. 2.

Figure 1:
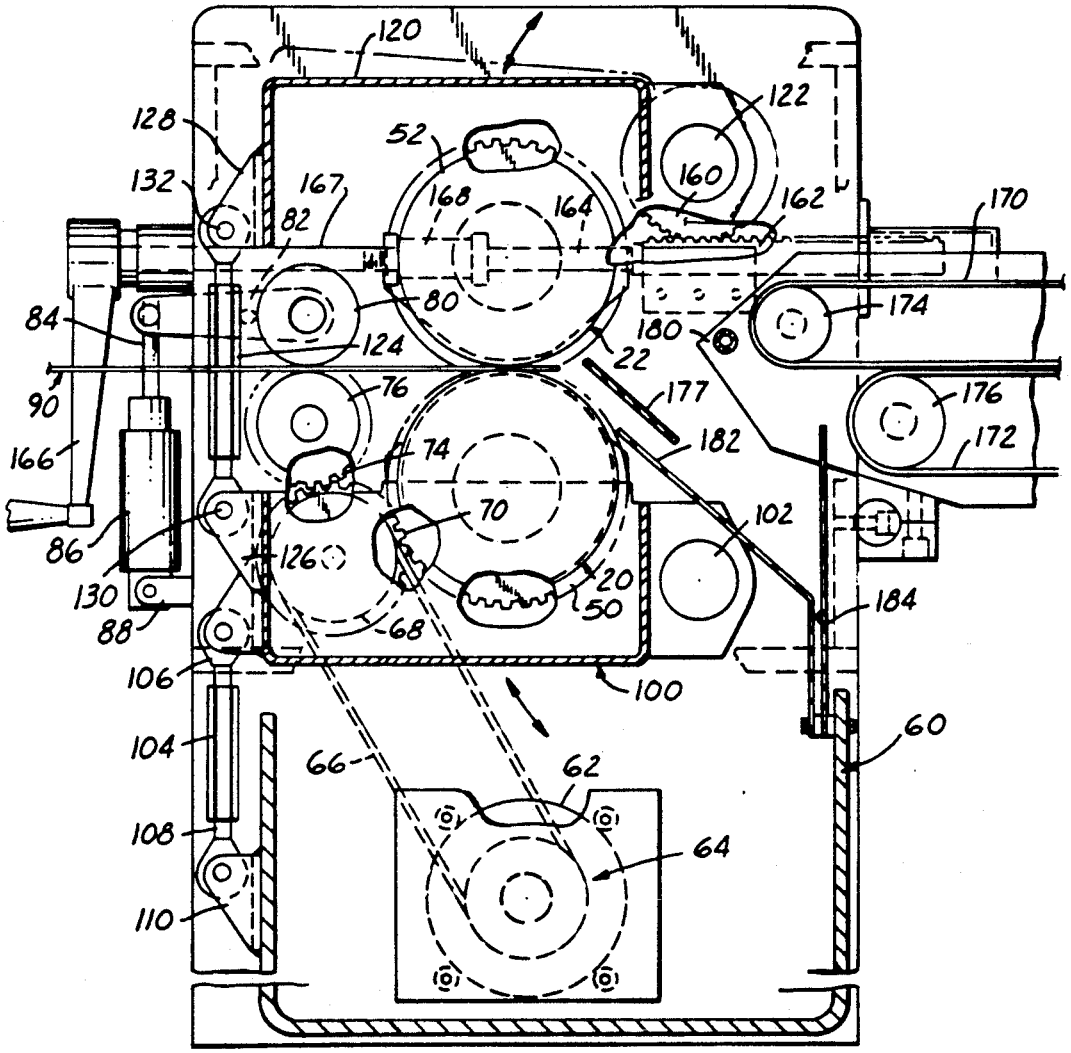
FIG. 1, a vertical section of the machine showing the significant parts of the invention.

DETAILED DESCRIPTION OF THE PRINCIPLES OF THE INVENTION AND THE MANNER AND PROCESS OF USING IT

Reference is first made to FIGS. 3 and 4 showing views of the anvil roller 20 and the cutter or knife roller 22. The cutter roller 22 has three knife blades 24,26 and 28 raised from the surface of the roller and extending the length of the roller. These blades are circumferentially spaced equally to coincide with the circumferential span of a certain number of teeth on a drive gear. This will be in the range of 45° to 50°.

The anvil roller 20 has an anvil surface 30 surrounded by a extended clearance surface 31. The anvil surface originates at 32 and terminates clockwise at 34. In this embodiment this anvil surface covers about 40°. Thus, only when the rollers 20 and 22 are oriented such that a particular blade registers with the anvil surface 30 will any cutting take place. Blades not so registered will fall in the clearance area and be ineffective as to a cutting function. In FIG. 3, the anvil surface 30 is an elongate insert 36 which can be suitably bolted in a recess on the roller.

The roller 22 also has three crease areas 40,42,44 with four ridges which cooperate with complemental depressions 46 in the anvil roller 20 to crease the bottom of a folder to facilitate expansion as the folder is filled in use. This is common practice. The depressions 46 can also be formed in an insert 47 secured in an elongate recess in roller 20.

As shown in FIG. 2, the rolls 20 and 22 have protruding stub axles 48 inserted in meshed side gears numbered respectively as 54,56, on the right side. On the left side axle 48 of roller 22 is inserted in gear 52. Suitable bolts 58 are used to secure the gears to the rollers. Each roller is mounted in a bearing block 57 at each end. Also, dowels 59 can be used to insure exact circumferential orientation with the gears. On the left end of roller 20 the gear 50 is integral with a drive shaft **50*a* journaled in a bearing block 50*b*. Drive gear 50 is meshed with gear 52 at the left end of roller 22**.

Now with reference to FIG. 1 a side view of the machine illustrates the assembly of drive parts and rollers. A frame housing 60 supports a motor 62 with a pulley 64 driving a belt 66 and a pulley 68. A basic drive gear 70 is coupled to the pulley 68 and meshed with a drive gear 50 for driving roller 22 through gear 52. Gear 50 is meshed with gear 52, and, as shown in FIG. 2, gear 54 on roller 20 is meshed with gear 56 on roller 22. Thus, with rollers 20 and 22 in operating relationship, the rollers and the gears at each end are in full engagement.

The basic drive gear 70 also is meshed with a gear 74 which drives a feed roller 76 opposed to a similar roller 80 mounted on the end of a lever 82, one end of which is coupled to a piston rod 84 extending from a fluid cylinder 86 anchored on a support bar 88. The lever 82 is suitably fulcrumed to exert a predetermined pressure on a supply strip of paper material 90 to assure positive feeding of the material to the cutting rollers 20,22.

The gear pulley 68, gear 70 and anvil roller 20 are mounted on a subframe 100 pivoted at 102 in the main frame 60. A tension rod with a turnbuckle 104 is anchored at the top on a link 106 and at the lower end 108 on a lug 110 on the main frame. Thus, the position of the subframe 100 and anvil roller 20 can be adjusted as desired in relation to the cutter roller 22.

Above the subframe 100 is a second subframe 120 pivoted at 122 on the main frame and controlled in location by a turnbuckle 124 anchored at a lower end on a bracket 126 and at the upper end on a bracket 128 attached to the upper subframe 120. Pins 130 and 132 transfix the eyes of the upper turnbuckle.

Figure 5:
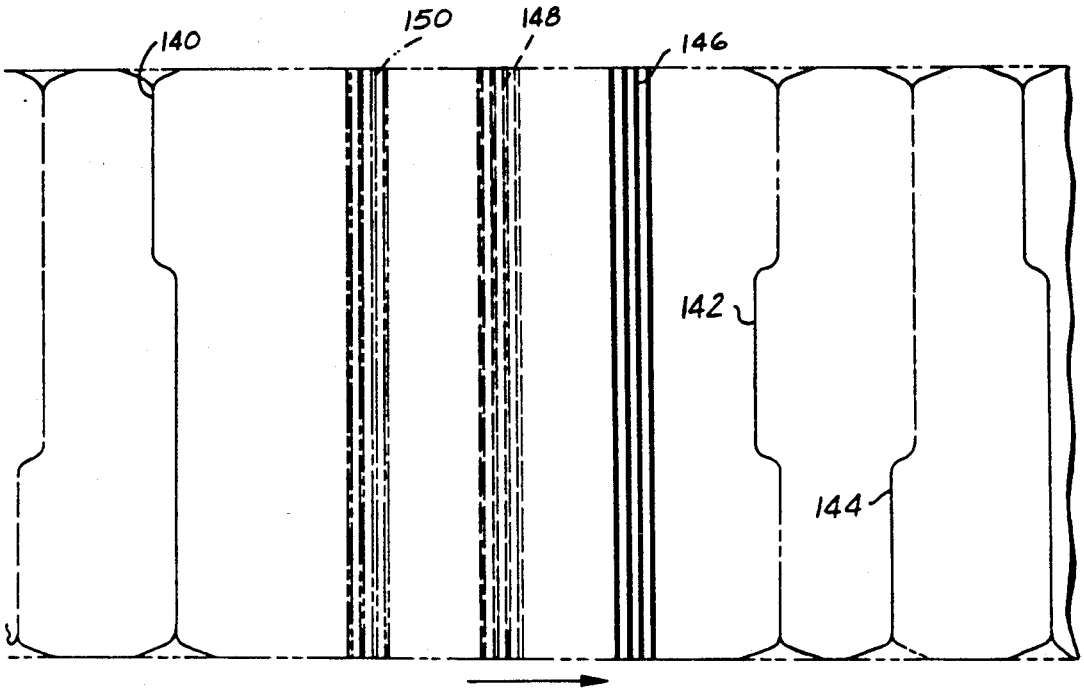
FIG. 5, a development view of the roller surface.

Turning now to FIG. 5, there is illustrated an unwrapped layout to illustrate the three possible edge cuts of the assembly. Three identification tabs are illustrated in progression at 140,142 and 144. Three crease locations 146, 148 and 150 are also shown.

To achieve the various tab cuts, it is necessary to position the circumferential location of the upper roller 22 so that the proper knife edge will register with the anvil area 30 on the bottom roller 22. This is accomplished by releasing the top subframe 120 by removing pin 130 on the lower end of turnbuckle 124. When the pin 130 is removed, the upper pivoted frame 120 is free to pivot about the axis 122. Since the upper frame 120 and the roller 20 are quite heavy, a means is provided to elevate the upper assembly. A gear 160 is affixed to the frame 120 coaxial with the pivot 122. A rack gear 162 on a slide shaft 164 is suitably mounted in the main frame 60. A hand crank 166 drives a screw shaft 167 acting in a nut 168 to translate the shaft 164 and rack gear 162. Once the pin 130 is released, the crank can be turned to lift the upper frame 120 and the roller 22 with gears 52 ad 56 (FIGS. 1 and 2) out of mesh with gears 50 and 54. The dot-dash lines in FIG. 1 show the elevated position.

With this disengagement, the upper roller and associated gears can be rotated to a new circumferential orientation. With the embodiment shown, a rotation of 22 teeth will position the top cutter roller for a second tab cut and also position the appropriate crease ridges in a commensurate position a proper distance from the cut line. Once the shifting of the top roller and gears is accomplished, the crank 166 can be turned to lower the top assembly and the pin 130 can be replaced and the machine ready for running a modified tab cut.

At the right-hand side of the assembly drawing of FIG. 1 are standard withdrawal (feed out) belts 170 and 172 suitably mounted on rollers 174,176. A diverter plate 177 is positioned to direct the cut sheets downward over plate ramp 182 into jam slot 184 where a fold occurs and the product is removed by the belts 170,172. A blower tube 180 may also be provided adjacent belt roller 174 and this blower can also be utilized to move emerging cut sheets down a ramp 182 into the jam slot 184 so that a fold takes place, and the folder is removed through the feed-out belts 170,172.

It will thus be seen that the machine is adapted to varying tab cuts by a rotation of the cutter blade roller without the necessity of removing and replacing a roller each time a tab change is needed. The downtime is greatly reduced and the cost of a machine is also reduced since one roller can take the place of three rollers. The turnbuckles 104 and 124 allow proper relative adjustment of the rollers to each other to insure a proper cut pressure and clearance.

Figure 6:
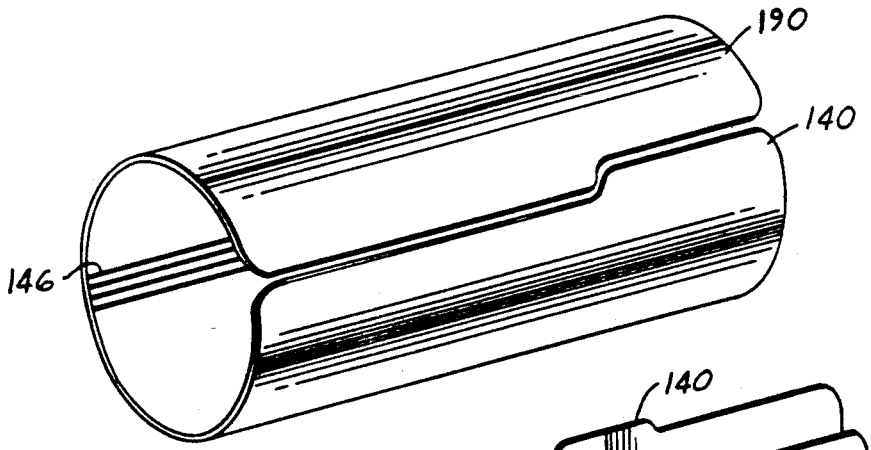
FIG. 6, a perspective view of a folder in roller condition.
Figure 7:
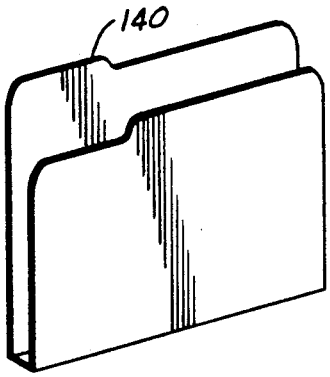
FIG. 7, a view of a completed folder with a left hand top tab.

In FIG. 6, a perspective view of a rolled folder 190 is shown and FIG. 7 illustrates a completed folder.

What is claimed is:

1. In a machine for cutting and forming manila folders and the like utilizing opposed cutting and anvil rollers, (a) a main frame, (b) an anvil roller having an axially extending anvil surface and rotatably mounted on a first axis in said main frame, (c) a cutting roller rotatably mounted in said frame on a second axis parallel to said first axis having a cylindrical surface with plurality of axially extending circumferentially-spaced, cutter projections raised from the surface, each to be selectively utilized in cooperation with said anvil roller, (d) power means for driving said rollers, (e) drive gear means on each said rollers coupled to said power means and meshed for simultaneous rotation, and (f) mounting means for one of said rollers and an associated drive gear to permit selective, temporary and simultaneous separation of said rollers and disengagement of said gears to change the circumferential relationship of one of said rollers and gears relative to the other roller and gears to shift the registration of one of said cutter projections on said cutter roller relative to the anvil on the anvil roller.

2. A machine as defined in claim 1 in which said mounting means comprises a first subframe releasably and pivotally movably mounted on said main frame on an axis parallel to said first and second axes, bearing means in said subframe mounting a roller and associated gears, first means for tilting said subframe to separate said rollers and respective drive gears, and second means independent of said first means releasably and adjustably locking said subframe relative to said main frame during operation of said machine, said second means being fastened to said main frame and to said subframe and releasable to permit said subframe to be tilted away from said main frame by said first means for circumferential adjustment of said cutter roller and a respective drive gear.

3. In a machine for cutting and forming manila folders and the like utilizing opposed cutting and anvil rollers, (a) a main frame, (b) an anvil roller having an axially extending anvil surface and rotatably mounted on said main frame, (c) a cutting roller rotatably mounted in said frame having a cylindrical surface with plurality of axially extending circumferentially-spaced, cutter projections raised from the surface, (d) power means for driving said rollers, (e) gear means on each said rollers coupled to said power means and meshed for simultaneous rotation, and (f) mounting means for one of said rollers to permit selective, temporary separation of said rollers and gears to change the circumferential relationship of one of said rollers and gears relative to the other roller and gears to shift the registration of a cutter projection on one roller relative to the anvil on the other roller, (g) said mounting means comprising a first subframe releasably and movably mounted on said main frame, bearing means in said subframe mounting a roller and associated gears, and means releasably and adjustably locking said subframe relative to said main frame during operation of said machine, (h) said first subframe being pivotally mounted at one end on said main frame on a pivot axis, a lift gear means on said first subframe concentric with said pivot axis, and a manually operable rack gear meshed with said lift gear to move said first subframe upwardly around said pivot axis.

4. A machine as defined in claim 3 in which said rack gear is mounted on a drive shaft, and crank means on said shaft external of said main frame to drive said rack gear.

5. In a machine for cutting and forming manila folders and the like utilizing opposed cutting and anvil rollers, (a) a main frame, (b) an anvil roller having an axially extending anvil surface and rotatably mounted on said main frame, (c) a cutting roller rotatably mounted in said frame having a cylindrical surface with plurality of axially extending circumferentially-spaced, cutter projections raised from the surface, (d) power means for driving said rollers, (e) gear means on each said rollers coupled to said power means and meshed for simultaneous rotation, and (f) mounting means for one of said rollers to permit selective, temporary separation of said rollers and gears to change the circumferential relationship of one of said rollers and gears relative to the other roller and gears to shift the registration of a cutter projection on one roller relative to the anvil on the other roller, (g) each said roller and associated gears being mounted on first and second subframes pivotally mounted on said main frame on spaced first and second axes, turnbuckle means associated with each said subframe to adjust the position of each said subframe relative to said main frame and said rollers to each other, and means releasably associated with one of said turnbuckle means to free a subframe for pivotal movement about an axis to separate said rollers and said meshed gears to allow circumferential rotation of one roller relative to the other to shift registration of a cutter projection relative to an anvil surface on the other of said rollers.

* * * * *